US006367992B1

(12) United States Patent
Aruga et al.

(10) Patent No.: US 6,367,992 B1
(45) **Date of Patent: *Apr. 9, 2002**

(54) PRINTING APPARATUS AND CONTROL METHOD THEREFOR

(75) Inventors: Kazuhisa Aruga, Suwa; Hidetake Mochizuki, Azusagawa-mura; Naohiko Koakutsu, Shiojiri; Kazuko Fukano, Matsumoto; Mitsuaki Teradaira, Shiojiri, all of (JP)

(73) Assignee: Seiko Epson Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/200,672

(22) Filed: Nov. 25, 1998

(30) Foreign Application Priority Data

Nov. 26, 1997 (JP) ..... 9-324811
May 18, 1998 (JP) ..... 10-135795

(51) Int. Cl.[7] ..... B41J 5/30
(52) U.S. Cl. ..... 400/76; 400/70; 400/61
(58) Field of Search ..... 400/76; 395/113; 358/1–13

(56) References Cited

U.S. PATENT DOCUMENTS 4,586,147 A 4/1986 Tadokoro
4,731,749 A 3/1988 Kirschner et al.
4,931,943 A * 6/1990 Vermesse ..... 364/464.02
5,023,813 A * 6/1991 Brown, III ..... 364/519
5,127,012 A * 6/1992 Hiliger ..... 371/29.1
5,224,157 A * 6/1993 Yamada et al. ..... 379/100
5,479,467 A 12/1995 Katsumata
5,550,956 A * 8/1996 Tadokoro ..... 395/113
5,654,902 A 8/1997 Scheidt et al.
RE35,751 E * 3/1998 Midgley ..... 399/25

FOREIGN PATENT DOCUMENTS

| | | |
|---|---|---|
| EP | 0 393 627 | 1/1990 |
| JP | 58-136473 | 8/1983 |
| JP | 63-179777 | 7/1988 |
| JP | 63-241630 | 10/1988 |
| JP | 02-165983 | 6/1990 |
| JP | 03-202373 | 9/1991 |
| JP | 04-305657 | 10/1992 |
| JP | 06-003956 | 1/1994 |
| JP | 06-015921 | 1/1994 |
| JP | 07-098555 | 4/1995 |
| JP | 08-025773 | 1/1996 |

* cited by examiner

*Primary Examiner*—John S. Hilten
*Assistant Examiner*—Charles H. Nolan, Jr.
(74) *Attorney, Agent, or Firm*—Mark P. Watson

(57) ABSTRACT

A printing apparatus for storing total operation counters for individual consumable and nonconsumable parts of a printing apparatus. A nonvolatile storage retains stored count information even when power is not supplied to the printing apparatus. An operations counter counts a value indicative of a printing apparatus operation. A counter storage stores a historical counter indicative of the printing apparatus operation history to the nonvolatile storage means based on a value counted by the operations counter, and stores a total printing apparatus operations count to the storage means. Specific printer operations, such as the number of characters printed, distance of recording medium transportation, and the number of times the automatic paper cutter is operated, can thus be individually accumulated, and the historical counts, that is, the cumulative counts since the printer was first used, can be stored to memory.

39 Claims, 6 Drawing Sheets

PRINTING APPARATUS AND CONTROL METHOD THEREFOR

BACKGROUND OF THE INVENTION

1. Field of the Invention

The present invention relates to a printing apparatus and to a control method therefor, and relates more specifically to a method for handling maintenance information in a printing apparatus that is part of a point-of-sale (POS) system or other financial transaction system.

2. Description of the Related Art

A conventional printing apparatus, hereafter simply "printer", typically stores an operating history of the printer in an EEPROM (electrically erasable programmable ROM), flash ROM, or other type of nonvolatile storage. This operating history typically represents the total number of operating hours, the number of characters printed, or some other measure(s) that can be used as a guide to determine when maintenance is required. When the printer is turned on and initialized, this operating history is usually downloaded from the nonvolatile memory to volatile memory such as RAM. The operating history is thus updated in RAM during printer operation, and written back to the nonvolatile memory as part of a shutdown procedure when the power is turned off, or at some regular interval, such as at a constant time interval or when some specified value is reached.

The operating history can also be read, displayed or printed in response to a command from a host device or operator command for user confirmation.

Japan Unexamined Patent Publication (kokai) H6-3956 (1994-3956) discloses a method for resetting historical data and starting the counter for a particular part when a part is replaced.

Japan Unexamined Patent Publication (kokai) H4-305657 (1992-305657) also discloses a method for redundantly storing historical data to a plurality of memory devices, thereby avoiding the problem of maintenance history data being lost as a result of a memory error or similar problem.

A problem with a printer as noted above is that usage of individual parts cannot be specifically determined from the total operating time of the printer. For example, assuming the same total operating time, use of the print head and paper transportation mechanism differ when printing only a few characters on many lines and when printing many characters on only a few lines. As a result, it is not possible to accurately determine a part's wear from the total operating time.

Furthermore, historical data such as the number of characters printed is typically reset when a part's useful life is exhausted and the part(s) is replaced based on this data. This makes it impossible to determine the total operating time or total operating count of other mechanical parts used to drive the parts that were replaced.

Total operating count information makes it possible to determine how much a product is actually used by the end user, and is effective for quality assurance and troubleshooting purposes.

This information can also be taken into consideration in the development of new products to help the manufacturer provide products with desirable specifications.

OBJECTS OF THE INVENTION

Therefore, it is an object of the present invention to overcome the aforementioned problems.

An object of the present invention is to provide a printing apparatus that can store total operating information for individual parts and components of the printing apparatus.

A further object of the present invention is to provide a printing apparatus capable of separately storing historical data related to user-replaceable consumables, and historical data related to parts that are not replaceable by the user, including parts and assemblies for driving other parts.

SUMMARY OF THE INVENTION

To achieve the above objects, a printing apparatus according to the present invention comprises: a nonvolatile storage for holding stored content even when power is not supplied to the printing apparatus; an operation counter for counting a, value indicative of a printing apparatus operation; an operation counter storage for storing a historical operation count of the printing apparatus based on a value counted by the operation counter, and a processor for writing an interim count value and a cumulative count value to the nonvolatile storage.

Specific printer operations, such as the number of characters printed, distance of recording medium transportation, and the number of times the automatic paper cutter is operated, can be individually accumulated, and the historical counts, that is, the cumulative counts since the printer was first used, can be stored in memory.

The nonvolatile storage or memory preferably comprises a plurality of areas for storing a respective plurality of historical operation counts such that count values from the operation counter storage can be written to each of the plurality of areas to store historical operation count values for a plurality of printer operations, and to store both interim and cumulative counts for each operation.

This configuration enables the cumulative operations counts to be it maintained even after a part or component has been replaced and its associated interim count has been reset.

The printing apparatus preferably further comprises a timer for measuring an operating time period of the printing apparatus; and an evaluation unit for determining whether the printing apparatus is performing a specific process. In this configuration the evaluation unit determines whether the specific process is in progress following expiration of the measured operating time period, and the historical count stored in the operation counter storage is written to the nonvolatile storage when the evaluation unit determines that the specific process is not in progress.

This configuration makes it possible to reduce the count information that is lost when the power is interrupted, for example. Printer operations are also not disrupted because writing data to the nonvolatile memory is prohibited during certain printer operations, including actual printing and data processing operations.

The count data stored in the operation counter storage further is preferably written to the nonvolatile storage when the evaluation unit determines that the specific process is not in progress, or when the evaluation unit determines that the specific process is in progress but the timer measures a second time period, which is longer than the operating time period, has elapsed.

By thus forcing writing to nonvolatile memory when a specific printer operation takes a long time, it is possible to avoid the situation where data is not stored for an extended period of time. As a result, it is also possible to reduce the count information that is lost when the power is interrupted, for example.

A printing apparatus according to the present invention yet further preferably comprises an operation count changing unit for changing a historical operation count stored in the nonvolatile storage based on a specific command received from a host device, and prohibiting changing a historical operation count stored in one area of the plurality of areas.

Memory can therefore be divided into an area that includes an interim count that can be reset when a part is replaced, and an area that includes a cumulative count that cannot be reset. As a result, accurate historical information can be maintained when there are parts that are replaced at different times, based on a cumulative count corresponding to the replaced part.

A printing apparatus according to the present invention yet further preferably comprises an operation count transmission unit for reading and sending to the host device a historical operation count stored in the nonvolatile storage based on a specific command received from the host device; and an operation count conversion unit for converting a historical operation count to an index enabling service life evaluation. In this configuration the operation count transmission unit sends the converted service life evaluation index obtained from the operation count conversion unit when sending a historical operation count to the host device.

The host device can thus obtain count values in a form enabling easier determination of component service life, which is particularly useful when service life is a function of both component operation and frequency of operation.

Yet further preferably, this printing apparatus comprises data conversion for coding the historical operation count or converted service life evaluation index obtained from the operation count conversion means. In this case, the operation count transmission unit sends the coded data to the host device. As a result, data can be sent reliably to the host device even when certain data cannot be transmitted due to interface limitations.

Yet further preferably, this printing apparatus comprises a display for displaying the service life evaluation index obtained by the operation count, conversion unit, and/or the historical operation count stored in the nonvolatile storage. The service life evaluation index obtained by the operation count; conversion unit, and/or the historical operation count stored in the nonvolatile storage can also be printed.

The operator can therefore also obtain the count information at the printer and take whatever maintenance steps may be required.

The operation count can alternatively be written to the nonvolatile storage irrespective of the operating time measurement in response to a specific command received from the host device. Data can therefore be stored at an appropriate timing to reduce the counter information that is lost when the power is interrupted, for example.

The present invention can also be provided as a control method for a printing apparatus with the same benefits and effects described above.

The control method of the present invention can also be provided as a control program that can be executed by a control device, and can be provided on a recording medium for storing this control program. Usable recording media include Compact Disc-ROM (CD-ROM) media, floppy disks, hard disks, magneto-optical discs, various digital versatile disc (DVD) formats, including DVD-ROM, as well as magnetic tape. Furthermore, these recording media can be used to provide the program of the invention to existing printing apparatuses. In addition, the program of the invention can be made available for delivery via a network such as the World Wide Web, including directly from a Web site, for downloading to an existing printer apparatus.

Other objects and attainments together with a fuller understanding of the invention will become apparent and appreciated by referring to the following description and claims taken in conjunction with the accompanying drawings.

BRIEF DESCRIPTIONS OF THE DRAWINGS

These and other objects and features of the present invention will be readily understood from the following detailed description taken in conjunction with preferred embodiments thereof with reference to the accompanying drawings, in which like parts are designated by like reference numerals and in which:

FIG. 1A is a block diagram of the CPU of the printing apparatus shown in. FIG. 1;

DESCRIPTION OF THE PREFERRED EMBODIMENTS

A preferred embodiment of a printing apparatus according to the present invention is described below with reference to the accompanying figures.

Figure 1:
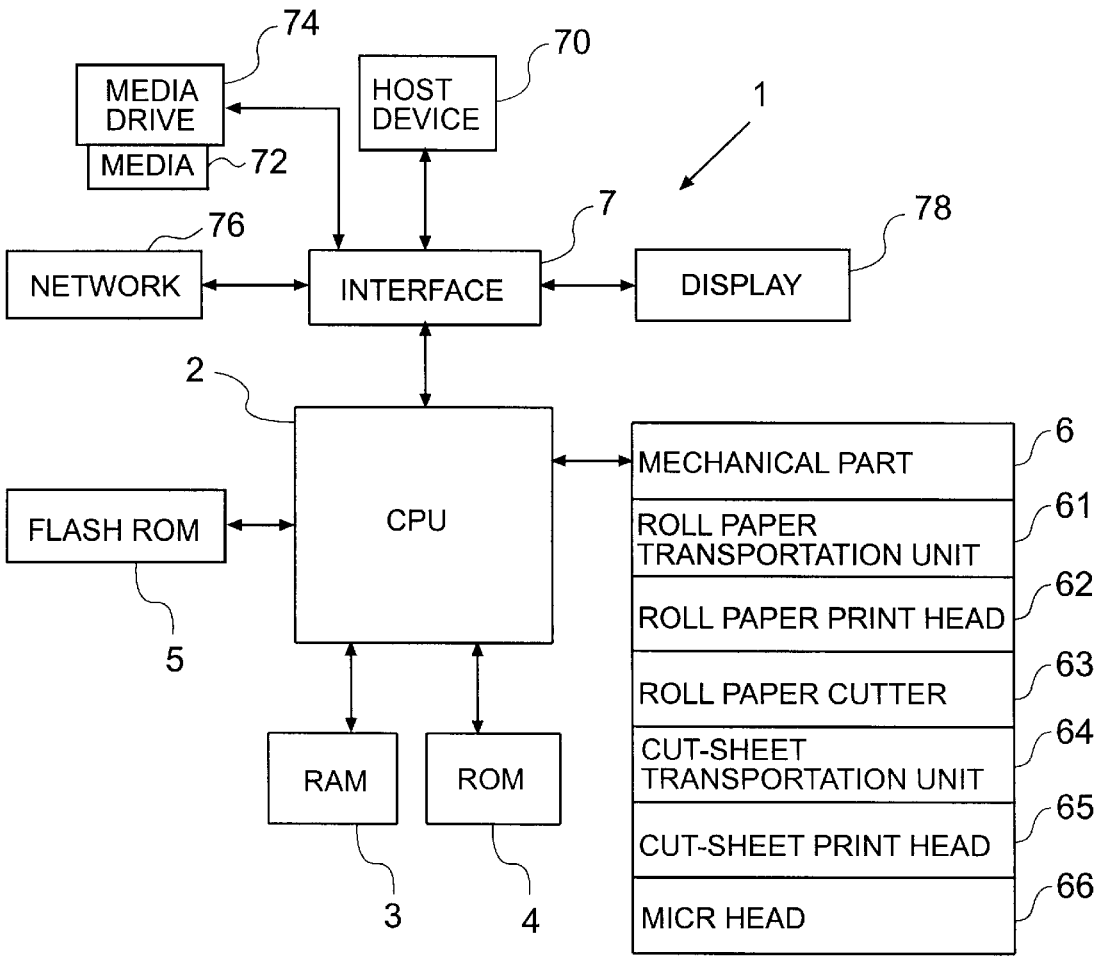
FIG. 1 is a block diagram showing an exemplary printing apparatus according to a preferred embodiment of the present invention.

FIG. 1 is a block diagram showing an exemplary printing apparatus ("printer" below) according to a preferred embodiment of the present invention. As shown in FIG. 1, a printer 1 exemplary of the invention comprises a central processing unit (CPU) 2 for overall control of the printer 1; random access memory (RAM) 3 that is used as primary working memory; read-only memory (ROM) 4 for storing control data, an application program, and related information; flash ROM memory 5 for storing information relating to the operating status of the printer 1; a mechanical part 6 enabling printing to paper using a print head; and an interface 7 for connecting the printer 1 to a host device 70. The method of the present invention can also be stored on a recording media 72, such as compact disc, floppy disk, hard disk, etc., and read into printer 1 through media drive 74, such as CD drive, floppy drive, hard drive, etc., and interface 7. The method of the present invention can also be stored at a remote location and transferred over network 76, e.g. LAN, WAN, WEB, to printer 1 via interface 7.

When printer 1 is connected to host device 70, print data, control commands, and other information is communicated between the printer 1 and host device via interface 7. Communicated data is buffered to RAM 3, which also provides temporary storage. The interface 7 can also be used to reset the CPU 2 by means of a signal line connected to the host device 70.

When CPU 2 initializes due to printer 1 power turning on or a signal from the host device via the interface 7 (referred to below as simply "initialization" ), CPU 2 reads a program from ROM 4, and executes the program to control printer 1. CPU 2 also interprets data received through interface 7 and buffered to RAM 3. If the buffered data is a control command for printing, CPU 2 accesses font data from ROM 4, and develops a print image in RAM 3. CPU 2 then controls driving mechanical part 6 to print the print image.

In a printer 1 according to this preferred embodiment, mechanical part 6 comprises a mechanism for printing on roll paper, that is, a roll paper transportation unit 61, a roll paper print head 62, and a roll paper cutter 63; and a mechanism for printing on cut-sheet forms, that is, a cut-sheet transportation unit 64, and a cut-sheet print head 65; and a magnetic ink character reader (MICR) head 66.

Figure 1A:
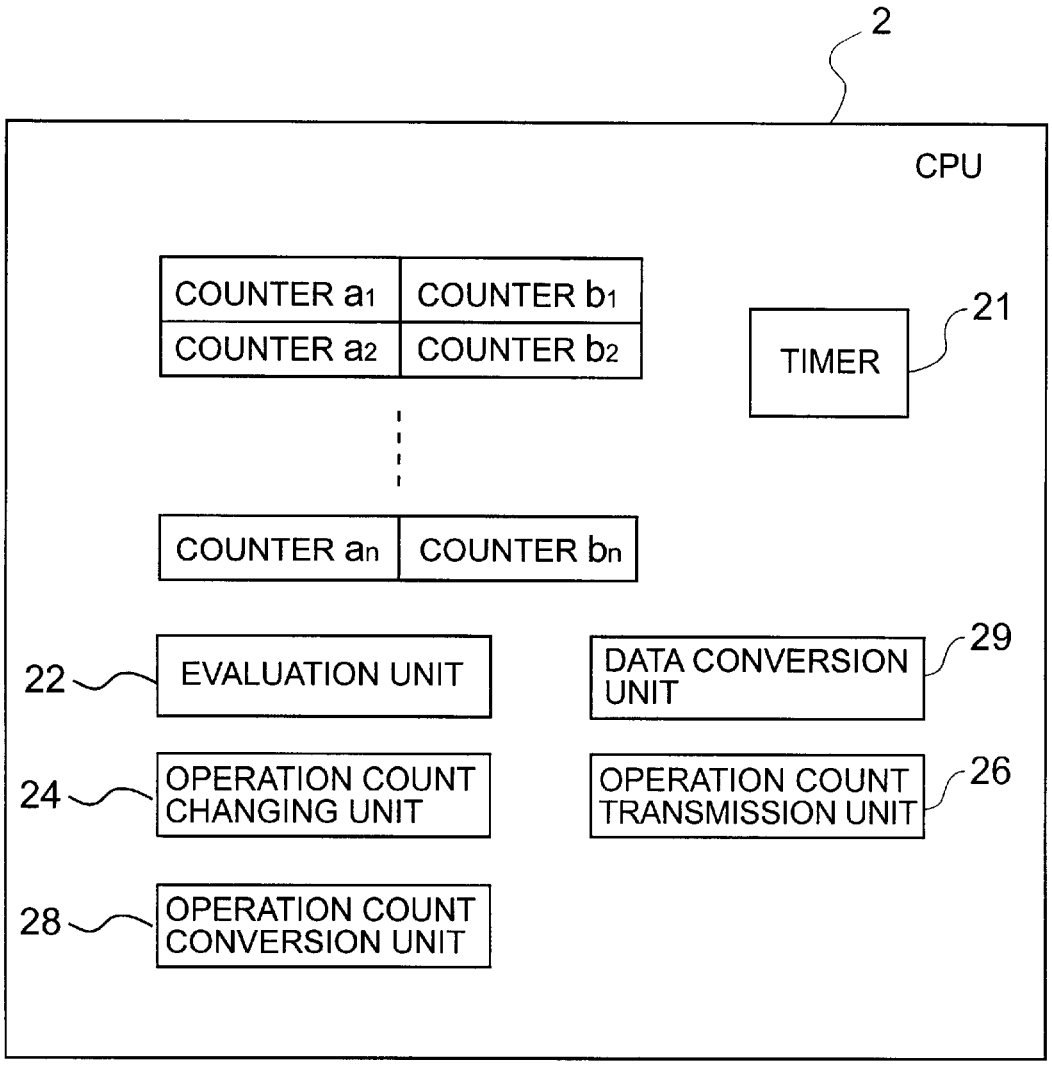

As shown in FIG. 1A, CPU 2 further comprises an internal timer 21 for issuing a timer interrupt at a preset interval. Time is thus counted according to a timer interrupt program stored in ROM 4 to measure the operating time of printer 1.

Flash ROM 5 can be read and written by CPU 2, and can hold stored content even when power is not supplied, i.e. it is nonvolatile. During printer 1 initialization, CPU 2 loads the printer operation count stored in flash ROM 5 into RAM 3, and thereafter updates the printer operation count by updating the value stored in RAM 3. The updated printer operation count is then written back to flash ROM 5 at a specific time interval together with the printer 1 operating time measured using the internal timer 21 of the CPU 2.

The time measurement operation executed according to the timer interrupt process noted above measures both the operating time of the printer 1, and measures the time interval for writing the count values from RAM 3 to the flash ROM 5. Data is written to flash ROM 5 at a specific write time interval, which in this preferred embodiment is defined as every time the timer 21 interrupt process detects that 2 minutes has passed.

It should be noted that this write time interval is appropriately determined with consideration given to flash ROM 5 life (number of write operations possible) and other printer 1 hardware considerations. For example, this write time interval will be different when the printer 1 shutdown procedure, i.e., the procedure controlling what events occur when the printer 1 power switch is turned off, (1) simply stops power supply immediately when the power switch is turned off, and (2) when the shutdown procedure first executes a software procedure for storing essential data before stopping the printer power supply when the printer power switch is turned off. In the first case (1), data will be lost if the power switch is turned off before the data has been stored, and more frequent updating is therefore desirable. As a result, the write time interval is set to a short interval, for example, 2 minutes. In the second case (2), however, data can be stored even after the power switch is turned off. The write time interval can therefore be set to a longer interval, such as 1 hour.

Exemplary printer operations to be counted and stored in flash ROM 5 are shown below. Note that each printer operation is tracked using two of a plurality of counter codes, which are used in an exemplary control command further described below. Exemplary counter codes for different printer operations follow:

| | |
|---|---|
| cut-sheet form line feeds | counter a = 10<br>counter b = 138 |
| cut-sheet form printed characters | counter a = 11<br>counter b = 139 |
| roll paper line feeds | counter a = 20<br>counter b = 148 |
| roll paper print head, power on | counter a = 21<br>counter b = 149 |
| roll paper cutter drive operations | counter a = 50<br>counter b = 178 |
| MICR read operations | counter a = 60<br>counter b = 188 |
| Product operating hours | counter a = 70<br>counter b = 198 |

As shown above and in FIG. 1A, printer 1 of this preferred embodiment has two counters $a_1, a_2 \ldots a_n, b_1, b_2 \ldots b_n$ for each monitored operation. Each of the counters, a and b, is independent of the other and is separately updated to track the same operation. The interim count value of counters $a_1 \ldots a_n$ can be changed using a control command; the cumulative count values of counters $b_1 \ldots b_n$, however, cannot be changed using a control command.

Figure 2:
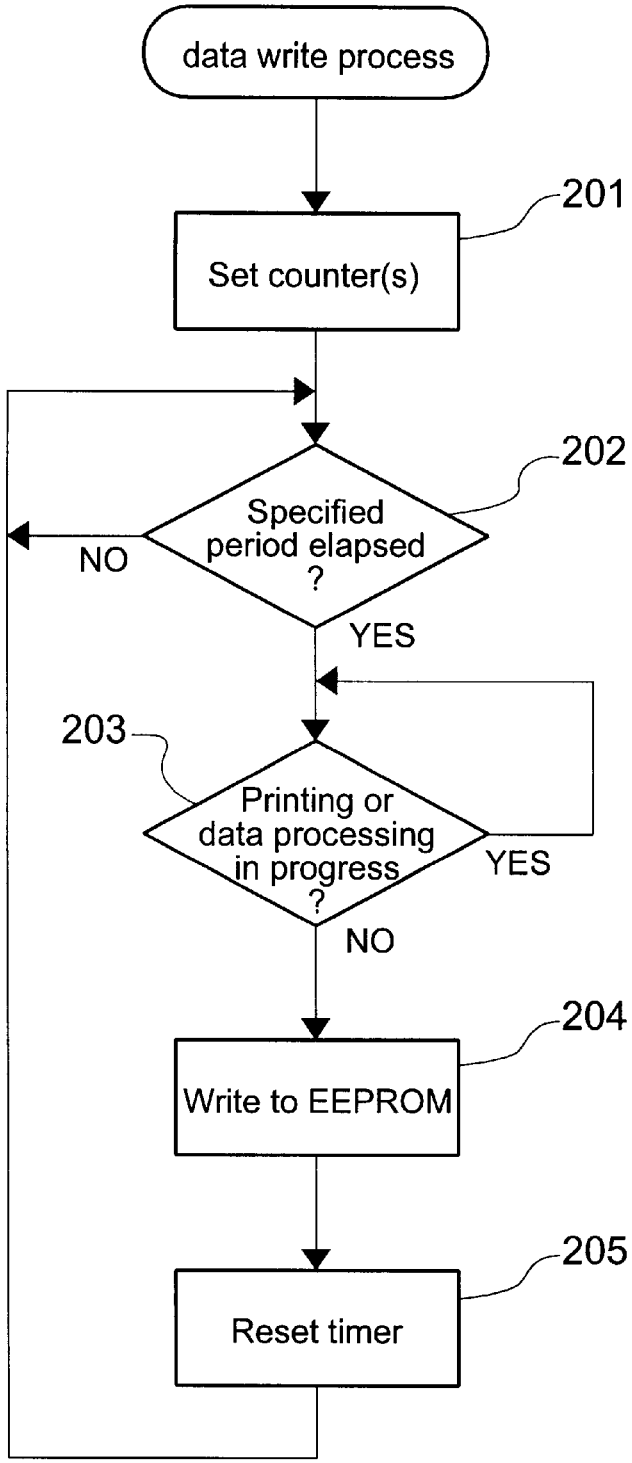
FIG. 2 is a flow chart of the write operation to a flash ROM device according to a first preferred embodiment of a printing apparatus shown in FIG. 1.

FIG. 2 is a flow chart of a flash ROM write control procedure. As count values from counters $a_1 \ldots a_n, b_1 \ldots b_n$ are updated in RAM 3 during printer 1 operation, they are regularly written to flash ROM 5 according to the procedure shown in FIG. 2 and described below.

During printer 1 initialization, count values for the counters stored in flash ROM 5 are loaded into RAM 3, and time measurement using the internal timer 21 begins (201). When a predetermined period, for example, 1 hour in this preferred embodiment, elapses (202) after time measurement begins, decision step 203 determines whether the printer is printing or processing data. If neither operation is in progress, the current count values are written to flash ROM 5 (204). Time measurement using the internal timer is then reset (205), and the procedure loops back to decision step 202. If decision step 203 determines that the printer is printing or processing data (203;Yes), however, data is not written to flash ROM 5. A drop in printer throughput resulting from writing to flash ROM 5 is thus avoided by writing to flash ROM 5 only when the printer is not printing or processing data, and not writing to flash ROM 5 when either operation is in progress.

Figure 3:
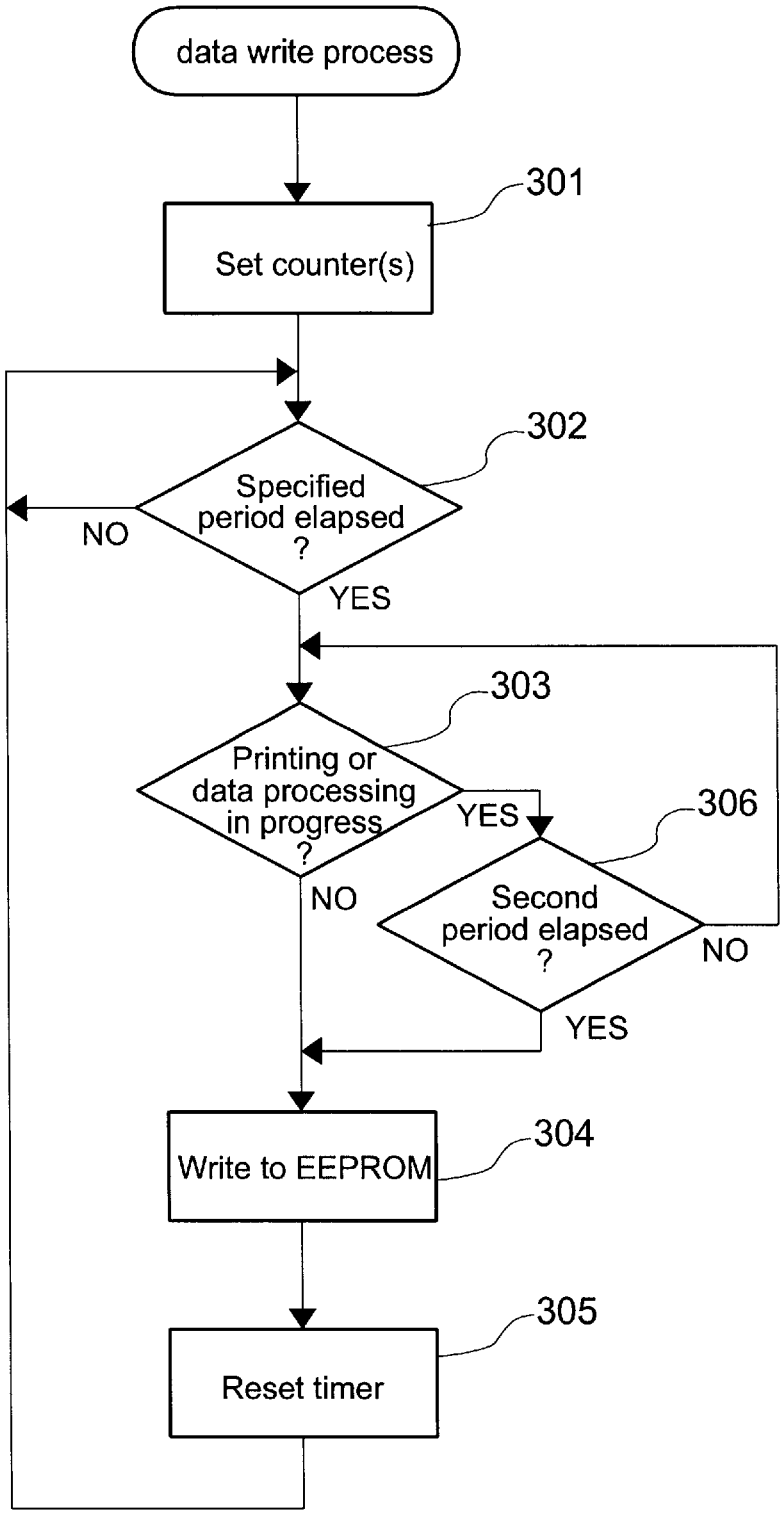
FIG. 3 is a flow chart of the write operation to a flash ROM device according to a second preferred embodiment of a printing apparatus shown in FIG. 1.

FIG. 3 is a flow chart of an alternative flash ROM write control procedure according to this preferred embodiment. This procedure differs from that shown in FIG. 2 in that time measurement continues when either printing or data processing is in progress, and flash ROM 5 is written within a second specified period (306) regardless of whether or not printing or data processing is still in progress .

During printer 1 initialization, count values for the counters stored in flash ROM 5 are written into RAM 3, and time measurement using the internal timer begins (301). When a first predetermined period elapses (302) after time measurement begins, decision step 303 determines whether the printer is printing or processing data. The decision as to whether or not the printer is printing or processing data is made by evaluation unit 22. Although evaluation unit 22 is shown as a separate block in FIG. 1A for illustration purposes, it will preferably comprise CPU 2 performing status checks (for the printer printing or processing data) under control of a software routine stored in ROM 4. However, evaluation unit 22 could also comprise dedicated logic or an ASIC. If neither operation is in progress (303;No), updated count values are written to flash ROM 5 (304). Time measurement using the internal timer is then reset (305), and the procedure loops back to decision step 302.

If decision step 303 determines that the printer is printing or processing data (303;Yes), however, data is not written to flash ROM 5, and the procedure branches to a second timing loop (306) in which a second period is counted using the internal timer.

This second period is longer than the first period, for example, 1 hour 10 minutes in this preferred embodiment. Whether both printing and data processing operations have stopped is continuously monitored (303) by evaluation unit 22 during this second period. If both printing and data processing operations stop (303;No) before this second period elapses, data is written to flash ROM 5 (304), time measurement using the internal timer is then reset (305), and the procedure loops back to step 302.

However, if printing or data processing are still in progress when the second period has elapsed (306;Yes), data is written to flash ROM 5 (304) anyway.

With the first timing method described above writing to flash ROM 5 is delayed when either printing or data processing is in progress. This method can therefore result in a long interval between flash ROM 5 writes, which can result in control information loss if, for example, the printer power is turned off or a CPU 2 being reset by a command posted over the signal line from the host device 70 via interface 7 and executed while writing to flash ROM 5 is delayed.

With a POS printer, for example, flash ROM writing could be delayed for an extended period of time while printing a daily sales report, a task that can take many minutes. Count values and control information will also continue to change as printing proceeds. If the power is then turned off and data is lost, count error increases and more control information is lost.

This problem can be avoided in a printer 1 according to this preferred embodiment by writing to flash ROM 5 within a maximum write interval determined by the second period (306) whether or not printing or data processing is in progress.

A control command for reading and writing count values from host device 70 is described next below. It will be noted that the cumulative values of the "b" counters above cannot be changed by this control command.

Figure 4:
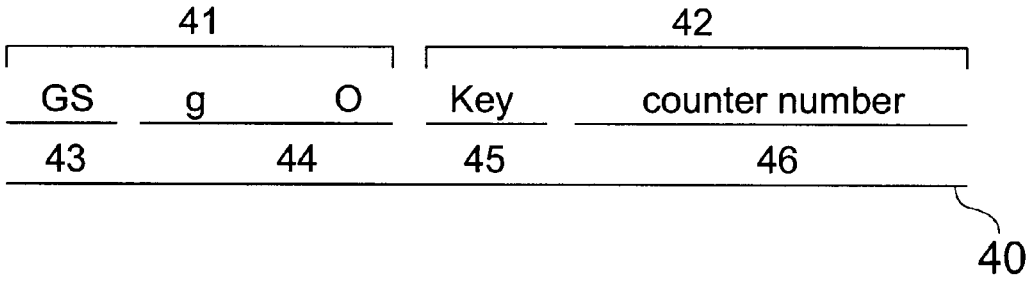
FIG. 4 is an example of a "change counter command" in the printing apparatus shown in FIG. 1.

A typical control command for changing a counter "a" value is shown in FIG. 4. This change counter command 40 comprises a command code part 41 and a parameter part 42. The command code part 41 comprises an extension 43 and function code 44, and the parameter part 42 comprises a function extension parameter 45 and a counter ID 46. The extension 43 is the ASCII control character "GS" for the hexadecimal character code 1D. The function code 44 is a code string for specifying the change counter function; two character codes are combined to specify the change counter function. The function extension parameter 45 specifies the key for changing the counter. The counter ID 46 identifies the counter number to change.

The operation count changing unit 24 of CPU 2 performs the following operations in response to the change counter command 40. Although operation count changing unit 24 is shown as a separate functional block in FIG. 1A, it will preferably comprise CPU 2 performing the following functions under control of a software routine stored in ROM 4. However, operation count changing unit 24 could also comprise dedicated logic or an ASIC.

(1) The key specified by the function extension parameter 45 is compared with a predetermined key; if the keys match, the specified counter value is changed. If the keys do not match, changing the counter is prohibited.

(2) The counter number specified by the counter ID 46 is compared with the interim counters "a" that can be changed. If the specified counter matches a counter "a", the value of the specified counter is changed. In this example, the counter is reinitialized to zero (0). If the specified counter does not match a counter "a", no counter is changed. As a result, the value of a cumulative "b" counter will not be changed.

(3) The change counter process is not executed if a print mode has been selected for printing by a print command after print data received from the host device has been developed in memory and buffered to the one-line print buffer, and unprinted data remain in the one-line print buffer. This prevents loss of unprinted data resulting from printer operations being stopped based on a memory error in the above change counter process, and thus protects unprinted print data.

(4) The change counter process is not executed if a print mode has been selected for printing by a print command after print data received from the host device has been developed in memory and buffered to the multiple line print buffer, and an area in which will be developed print data is set in the multiple line print buffer if no print data is developed in the area. This prevents loss of unprinted data resulting from printer operations being stopped based on a memory error in the above change counter process, and thus protects unprinted print data.

(5) If a write error occurs during writing, the error is announced using an LED or buzzer, and/or by sending an error status signal or changing the state of the signal line to the host device via the interface 7. The operator or host device can thus be informed that the counter could not be normally updated as a result of an error occurring in the printer 1.

(6) Count values of counters stored in RAM 3 are written to flash ROM 5 even if the timer interrupt process of the internal timer does not indicate it is the normal flash ROM 5 write timing. The flash ROM 5 is also written when the change counter command 40 is processed to prevent loss of any count values; changed by the change counter command 40 as a result of CPU 2 being reset by a command posted over the signal line from the host device, via the interface 7, before the changed counter is written to flash ROM 5 according to the normal flash ROM write timing. It will also be obvious that the same result can be achieved by providing a separate flash ROM 5 write command, and using the flash ROM write command together with the change counter command 40.

Figure 5:
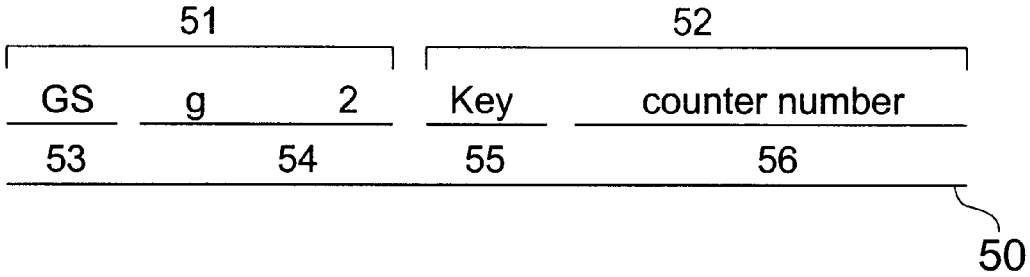
FIG. 5 is an example of a "send counter command" in the printing apparatus shown in FIG. 1.

A typical control command for reading a count value of a counter from a host device is shown in FIG. 5. This send counter command 50 comprises a command code part 51 and a parameter part 52. The command code part 51 comprises an extension 53 and function code 54, and the parameter part 52 comprises a function extension parameter 55 and a counter ID 56. The extension 53 is the ASCII control character "GS" for the hexadecimal character code iD. The function code 54 is a code string for specifying the send counter function; two character codes are combined to specify the send counter function. The function extension parameter 55 specifies the send counter function key. The counter ID 56 identifies the counter number to send.

The operation count transmission unit of CPU 2 performs the following operations in response to the send counter command 50 received from the host device. Although operation count transmission unit 26 is shown as a separate functional block in FIG. 1A, it will preferably comprise CPU 2 performing the following functions under control of a software routine stored in ROM 4. However, operation count transmission unit 26 could also comprise dedicated logic or an ASIC.

(1) The key specified by the function extension parameter 55 is compared with a predetermined key; if the keys match, the count value of the specified counter is sent. If the keys do not match, sending is prohibited.

(2) If the counter specified by the counter ID 56 is a counter that is being counted (tracked), the counter value stored in RAM 3 is read. If the specified counter ID does not match that of any counter, the send command is ignored.

(3) If a read error occurs during transmission, the error is announced using an LED or buzzer, and/or by sending an error status signal or changing the state of the signal line to the host device via the interface 7. The operator or host device can thus be informed that the counter could not be sent as a result of an error occurring in the printer 1.

(4) A header code or terminate code can be added to the transmitted data to enable the host device, for example, to easily recognize the beginning and end of the transmitted data.

The operation count conversion unit 28 of CPU 2 also executes the following process before transmitting a count value to the host device. Although operation count conversion unit 28 is shown as a separate functional block in FIG. 1A, it will preferably comprise CPU 2 performing the following functions under control of a software routine stored in ROM 4. However, operation count conversion unit 28 could also comprise dedicated logic or an ASIC.

(5) Step 1: Convert the count value

Count values that can be used for determining component service life include values that can be easily used directly, and values that are difficult to use directly. For easy-to-use count values, the data can be sent directly. Values that are difficult to use, however, typically need to be converted to an expression that can be easily interpreted for service life determinations.

Consider, for example, the line feed count for cut-sheet forms. The drive power source for the cut-sheet transportation unit 64 is a stepping motor (not shown in the figures). The CPU 2 counts the number of steps taken by the stepping motor, and stores this simple step count. For the user, however, it is extremely difficult to grasp how much paper has been advanced using this step count.

The line feed distance of a printer 1 according to this preferred embodiment is ⅙ inch, and the cut-sheet transportation unit 64 must drive the stepping motor 24 steps to advance a cut-sheet form ⅙ inch. The CPU 2 therefore obtains a line feed count by dividing this step count by 24.

(6) Step 2: Convert count values and converted count values for transmission

Various problems can arise with sending count values and converted count values directly to the host device. For example, a transmitted value could match another control code and prevent normal operation. In some cases data cannot be sent in 7-bit words. The data conversion unit 29 according to this preferred embodiment therefore converts the count values and converted count values to a decimal character code before transmission. Although data conversion unit 29 is shown as a separate functional block in FIG. 1A, it will preferably comprise CPU 2 performing data conversion under control of a software routine stored in ROM 4. However, data conversion unit 29 could also comprise dedicated logic or an ASIC.

For example, consider the converted cut-sheet form line feed count 00001100H. This value converts easily to the four bytes 00H, 00H, 11H, 00H where 11H is the same as the XON code and could result in a handshake error. The line feed count 00001100H is therefore converted to the decimal code 4352D, which is transmitted using the four bytes 34H, 33H, 35H, 32H.

A printer 1 according to the present invention also has a test printing mode in which data not received from the host device is printed. This test printing mode can be accessed in a printer 1 according to the present embodiment by, for example, turning the power switch on while holding the paper feed switch depressed.

Figure 6:
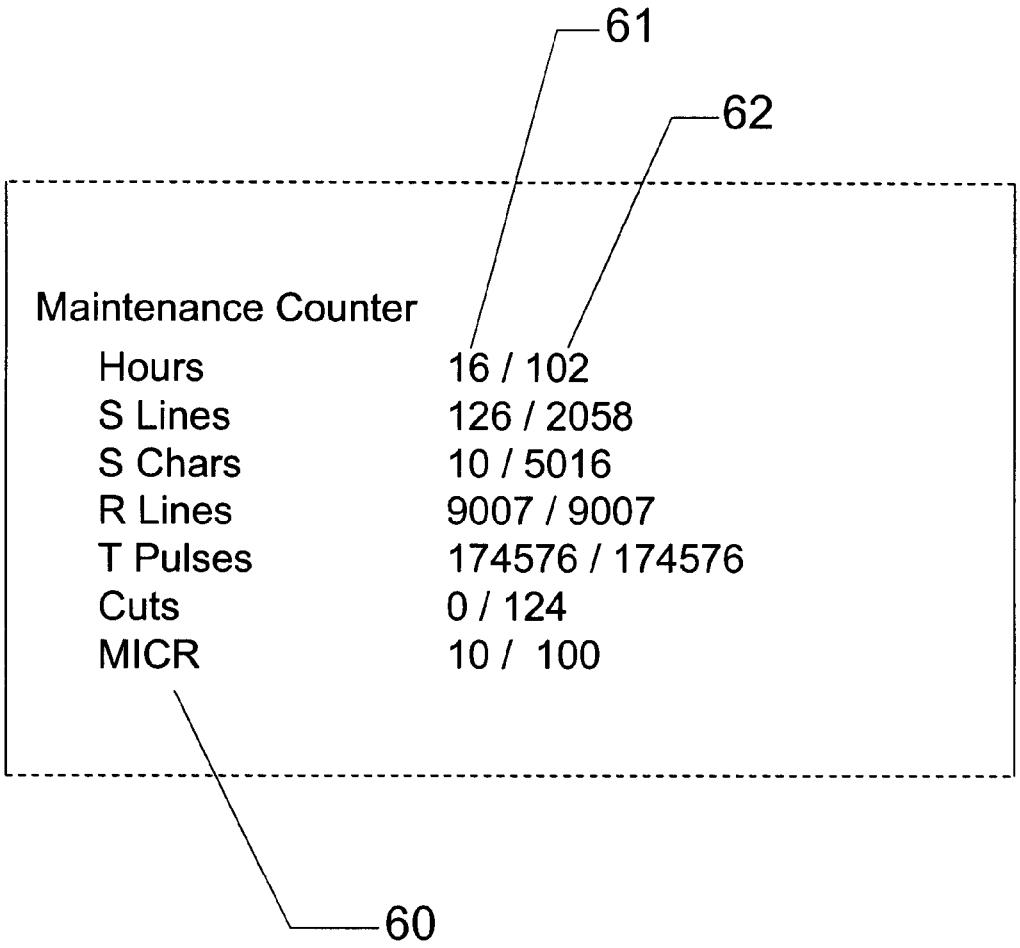
FIG. 6 is a display or print sample from a test print mode in the printing apparatus shown in FIG. 1.

When this test printing mode is selected, printer 1 displays on display 78 or prints with mechanical printer part 6 the same counter information sent to the host device when it receives a send counter command 50. As shown in FIG. 6, which illustrates a sample of the display or printer output in the test printing mode, the test printing mode printout includes the maintenance items 60 being counted, and count values 61 and 62 corresponding to interim counter a and cumulative counter b values for each item.

It should be further noted that the count values can be checked and confirmed by a printer 1 according to the present embodiment even when the printer 1 is not connected to a host device.

The counters also continue to increment while printing in the test printing mode. The test printing mode does not continue for the two minute write interval of the present embodiment, however, and RAM 3 content can therefore be lost if the power is turned off before the flash ROM 5 write timing. To prevent data loss in this case, data is updated to the flash ROM 5 even before the timer interrupt process of the internal timer detects the flash ROM write timing.

Although the present invention has been described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims, unless they depart therefrom.

The present invention has been described using counters that can be reset and counters that cannot be reset. It will be obvious to one with ordinary knowledge in the related art, however, that the same effect can be achieved using only one counter by storing any counter values to a non-volatile memory when a component is replaced. For example, if only resettable counters are used, the total or cumulative operating count can be derived from the sum of the current counter value and the stored counter value. Furthermore, if only non-resettable counters are used, component service life can be derived from the difference between the current counter value and the stored counter value.

It will also be obvious that while flash ROM has been described as the nonvolatile memory for storing historical operating data for the printer 1, an EEPROM or other nonvolatile storage device can be used.

The data stored in nonvolatile memory shall also not be limited to that described above. For example, any data relating to the operating status of the printer can be used, or a subset of any of the above data can be used. Nonvolatile memory can also be used to store font data, application program data, or other information in addition to the above-noted operating status and counter data.

Furthermore, a real-time clock or other device can be used in place of the internal timer of the CPU described above as being used for measuring total operating time, write time, and other time-based parameters.

A printer 1 according to this preferred embodiment has also been described as determining at a constant time interval whether a specific process is executing. However, this interval can be defined on the basis of some other value that changes with printer operation, including the number of pages printed or the number of lines printed.

It is therefore possible by means of the present invention to easily check the wear on consumables, the service life of non-replaceable components associated with consumables, and other information associated with printer quality assurance, by storing a historical operating count for the printer 1 to a plurality of storage areas or memory device.

While the invention has been described in conjunction with several specific embodiments, it is evident to those skilled in the art that many further alternatives, modifications and variations will be apparent in light of the foregoing description. Thus, the invention described herein is intended to embrace all such alternatives, modifications, applications and variations as may fall within the spirit and scope of the appended claims.

What is claimed is:

1. A printing apparatus adapted to be connected to a host device for printing in response to commands and data received from the host device, the printing apparatus comprising:

a first counter for counting a first count value indicative of an interim number of times the printing apparatus performed a predetermined operation;

a second counter for counting a second count value indicative of a cumulative number of times the printing apparatus performed the predetermined operation;

an operation count changing unit for changing the first count value in response to a first command received from the host device while prohibiting change of the second count value; and an operation count transmission unit for sending to the host device one or more of the first and second count values in response to one or more second commands received from the host device.

2. The printing apparatus of claim 1, further comprising a nonvolatile storage for storing the first and second count values.

3. The printing apparatus of claim 1 further comprising:

a plurality of first counters each for counting a first count value indicative of an interim number of times the printing apparatus performed one of a plurality of predetermined operations; and a plurality of corresponding second counters each for counting a second count value indicative of a cumulative number of times the printing apparatus performed the corresponding operation.

4. The printing apparatus of claim 2, further comprising:

a timer for measuring an operating time interval of the printing apparatus;

an evaluation unit for determining whether the printing apparatus is performing at least one of a select number of processes after a time interval measured by the timer expires; and a processing unit for writing the first and second count values to the nonvolatile storage in response to a determination by the evaluation unit that none of said selected number of processes is being performed.

5. The printing apparatus of claim 4, wherein the timer measures an extended operating time interval of the printing apparatus, the extended operating time interval being longer than the operating time interval, and the processing unit is responsive to an indication by the timer of the expiration of the extended operating time interval for writing the first and second count values to the nonvolatile storage irrespective of the determination by the evaluation unit.

6. The printing apparatus of claim 4, wherein the processing unit is responsive to a third command received from the host device for writing the first and second count values to the nonvolatile storage irrespective of the operating time measurement.

7. The printing apparatus of claim 1, further comprising an operation count conversion unit for converting one of the count values to a service life evaluation index, wherein the operation count transmission unit sends the converted service life evaluation index to the host device.

8. The printing apparatus of claim 7, further comprising a data conversion unit for coding into coded data at least one of the count value and the converted service life evaluation index, wherein the operation count transmission unit sends the coded data to the host device.

9. The printing apparatus of claim 7, further comprising a display for displaying at least one of the count value and the service life evaluation index.

10. The printing apparatus of claim 7, further comprising an operation count printing unit for printing at least one of the count value and the service life evaluation index.

11. A method of controlling a printing apparatus adapted to be connected to a host device for printing in response to commands and data received from the host device, the method comprising:

counting a first count value indicative of an interim number of times the printing apparatus performed a predetermined operation;

counting a second count value indicative of a cumulative number of times the printing apparatus performed the predetermined operation;

changing the first count value in response to a first command received from the host device while prohibiting change of the second count value; and sending to the host device one or more of the first and second count values in response to one or more second commands received from the host device.

12. The method of claim 11, further comprising writing the first and second count values to a nonvolatile storage.

13. The method of claim 11, further comprising:

counting a plurality of first count values each indicative of an interim number of times the printing apparatus performed one of a plurality of predetermined operations; and counting a corresponding plurality of second count values each indicative of a cumulative number of times the printing apparatus performed the corresponding operation.

14. The method of claim 12, further comprising:

measuring an operating time interval of the printing apparatus; and determining whether the printing apparatus is performing at least one of a select number of processes after a time interval measured in the measuring step, wherein the writing step is performed in response to a determination in the determining step that none of said selected number of processes is being performed.

15. The method of claim 14, wherein measuring step comprises measuring an extended operating time interval of the printing apparatus, the extended operating time interval being longer than the operating time interval, and the writing step is performed in response to an indication of the expiration of the extended operating time interval irrespective of the determination in the determining step.

16. The method of claim 14, wherein the writing step is performed in response to a third command received from the host device irrespective of the operating time measurement.

17. The method of claim 11, further comprising converting one of the count values to a service life evaluation index, wherein the sending step comprises sending the converted service life evaluation index to the host device.

18. The method of claim 17, further comprising coding into coded data at least one of the count value and the converted service life evaluation index, wherein the sending step comprises sending the coded data to the host device.

19. The method of claim 17, further comprising displaying at least one of the count value and the service life evaluation index.

20. The method of claim 17, further comprising printing at least one of the count value and the service life evaluation index.

21. A recording medium readable by a machine and embodying program instructions executable by the machine to perform a control method for a printing apparatus, the printing apparatus adapted to be connected to a host device for printing in response to commands and data received from the host device, the control method comprising:

counting a first count value indicative of an interim number of times the printing apparatus performed a predetermined operation;

counting a second count value indicative of a cumulative number of times the printing apparatus performed the predetermined operation;

changing the first count value in response to a first command received from the host device while prohibiting change of the second count value; and sending to the host device one or more of the first and second count values in response to one or more second commands received from the host device.

22. The medium of claim 21, wherein the control method further comprises writing the first and second count values to a nonvolatile storage.

23. The medium of claim 21, wherein the control method further comprises:

counting a plurality of first count values each indicative of an interim number of times the printing apparatus performed one of a plurality of predetermined operations; and counting a corresponding plurality of second count values each indicative of a cumulative number of times the printing apparatus performed the corresponding operation.

24. The medium of claim 22, wherein the control method further comprises:

measuring an operating time interval of the printing apparatus; and determining whether the printing apparatus is performing at least one of a select number of processes after a time interval measured in the measuring step, wherein the writing step is performed in response to a determination in the determining step that none of said selected number of processes is being performed.

25. The medium of claim 24, wherein the measuring step comprises measuring an extended operating time interval of the printing apparatus, the extended operating time interval being longer than the operating time interval, and the writing step is performed in response to an indication of the expiration of the extended operating time interval irrespective of the determination in the determining step.

26. The medium of claim 24, wherein the writing step is performed in response to a third command received from the host device irrespective of the operating time measurement.

27. The medium of claim 21, wherein the control method further comprises converting one of the count values to a service life evaluation index, wherein the sending step comprises sending the converted service life evaluation index to the host device.

28. The medium of claim 27, wherein the control method further comprises coding into coded data at least one of the count value and the converted service life evaluation index, wherein the sending step comprises sending the coded data to the host device.

29. The medium of claim 27, wherein the control method further comprises displaying at least one of the count value and the service life evaluation index.

30. The medium of claim 27, wherein the control method further comprises printing at least one of the count value and the service life evaluation index.

31. A printing apparatus adapted to be connected to a host device for printing in response to commands and data received from the host device, the printing apparatus comprising:

a counter for counting a count value indicative of a number of times the printing apparatus performed a predetermined operation;

a nonvolatile storage for storing the count value as first history information, and for storing a reference value in response to a first command received from the host device, the reference value being the count value at the time of receiving the first command; and an operating count transmission unit for obtaining the difference between the first history information and the reference value as second history information, and for sending one or more of the first history information and the second history information to the host device in response to one or more second commands received from the host device.

32. A method of controlling a printing apparatus adapted to be connected to a host device for printing in response to commands and data received from the host device, the method comprising:

counting a count value indicative of a number of times the printing apparatus performed a predetermined operation;

storing the count value as first history information in a nonvolatile storage;

storing a reference value in the nonvolatile storage in response to a first command received from the host device, the reference value being the count value at the time of receiving the first command;

obtaining the difference between the first history information and the reference value as second history information; and sending one or more of the first history information and the second history information to the host device in response to one or more second commands received from the host device.

33. A recording medium readable by a machine and embodying program instructions executable by the machine to perform a control method for a printing apparatus, the printing apparatus adapted to be connected to a host device for printing in response to commands and data received from the host device, the control method comprising:

counting a count value indicative of a number of times the printing apparatus performed a predetermined operation;

storing the count value as first history information in a nonvolatile storage;

storing a reference value in the nonvolatile storage in response to a first command received from the host device, the reference value being the count value at the time of receiving the first command;

obtaining the difference between the first history information and the reference value as second history information; and sending one or more of the first history information and the second history information to the host device in response to one or more second commands received from the host device.

34. A printing apparatus adapted to be connected to a host device for printing in response to commands and data received from the host device, the printing apparatus comprising:

a counter for counting a first count value indicative of a number of times the printing apparatus performed a predetermined operation;

a nonvolatile storage for storing the first count value as first history information, and for storing a second count value indicative of a cumulative number of times the printing apparatus performed the predetermined operation;

an operation count changing unit for adding the first count value to the second count value and changing the first count value in response to a first command received from the host device; and an operating count transmission unit for obtaining the sum between the first history information and the second count value as second history information, and for sending one or more of the first history information and the second history information to the host device in response to one or more second commands received from the host device.

35. A method of controlling a printing apparatus adapted to be connected to a host device for printing in response to commands and data received from the host device, the method comprising:

counting a first count value indicative of a number of times the printing apparatus performed a predetermined operation;

storing in a nonvolatile storage the first count value as first history information;

storing in the nonvolatile storage a second count value indicative of a cumulative number of times the printing apparatus performed the predetermined operation;

adding the first count value to the second count value and changing the first count value in response to a first command received from the host device;

obtaining the sum between the first history information and the second count value as second history information; and sending one or more of the first history information and the second history information to the host device in response to one or more second commands received from the host device.

36. A recording medium readable by a machine and embodying program instructions executable by the machine to perform a control method for a printing apparatus, the printing apparatus adapted to be connected to a host device for printing in response to commands and data received from the host device, the control method comprising:

counting a first count value indicative of a number of times the printing apparatus performed a predetermined operation;

storing in a nonvolatile storage the first count value as first history information;

storing in the nonvolatile storage a second count value indicative of a cumulative number of times the printing apparatus performed the predetermined operation;

adding the first count value to the second count value and changing the first count value in response to a first command received from the host device;

obtaining the sum between the first history information and the second count value as second history information; and sending one or more of the first history information and the second history information to the host device in response to one or more second commands received from the host device.

37. The printing apparatus of claim 1, wherein the operation count transmission unit sends the one or more count values to the host device in response to one or more parameters specified in the one or more second commands.

38. The method of claim 11, wherein the one or more count values are sent to the host device in response to one or more parameters specified in the one or more second commands.

39. The medium of claim 21, wherein the one or more count values are sent to the host device in response to one or more parameters specified in the one or more second commands.

* * * * *